US007775065B2

(12) United States Patent
Ouseph et al.

(10) Patent No.: US 7,775,065 B2
(45) Date of Patent: Aug. 17, 2010

(54) METHODS AND APPARATUS FOR OPERATING A REFRIGERATOR

(75) Inventors: John P. Ouseph, Louisville, KY (US); Martin C. Severance, Louisville, KY (US); Michelle Dahl, Louisville, KY (US); Arun Talegaonkar, Louisville, KY (US); Steve Root, Buckner, KY (US); Brian Aiken, Louisville, KY (US); Debra Miozza, Louisville, KY (US); Patrick David Galbreath, Louisville, KY (US)

(73) Assignee: General Electric Company, Schenectady, NY (US)

( * ) Notice: Subject to any disclaimer, the term of this patent is extended or adjusted under 35 U.S.C. 154(b) by 662 days.

(21) Appl. No.: 11/036,749

(22) Filed: Jan. 14, 2005

(65) Prior Publication Data

US 2006/0156755 A1 Jul. 20, 2006

(51) Int. Cl.
*F25D 11/02* (2006.01)

(52) U.S. Cl. ..... 62/441; 62/443

(58) Field of Classification Search ..... 62/441, 62/440, 443; 362/92
See application file for complete search history.

(56) References Cited

U.S. PATENT DOCUMENTS 3,437,087 A * 4/1969 Price ..... 126/191
4,368,622 A * 1/1983 Brooks ..... 62/157
4,920,765 A 5/1990 McCauley et al.
5,092,137 A 3/1992 Elsom
5,097,675 A * 3/1992 Elsom et al. ..... 62/408
5,191,773 A * 3/1993 Cassell ..... 62/373
5,392,615 A 2/1995 Lim
5,417,080 A 5/1995 Bishop
5,555,189 A * 9/1996 Yamazato et al. ..... 700/286
5,611,212 A 3/1997 Graviss et al.
5,632,160 A 5/1997 Harangozo et al.
6,044,654 A * 4/2000 Igari et al. ..... 62/186
6,196,011 B1 * 3/2001 Bessler ..... 62/186
6,539,729 B2 4/2003 Tupis et al.
6,565,169 B1 5/2003 Moreno-Olguin et al.
6,655,169 B2 12/2003 Tupis et al.
6,675,603 B1 1/2004 Lesyna et al.
6,679,065 B1 1/2004 Bessler et al.
6,802,369 B2 * 10/2004 Zentner et al. ..... 165/267
2002/0100829 A1 * 8/2002 Sasaki et al. ..... 242/332.4
2003/0090890 A1 * 5/2003 Miozza et al. ..... 362/92
2003/0115892 A1 * 6/2003 Fu et al. ..... 62/187

* cited by examiner

*Primary Examiner*—Mohammad M Ali
(74) *Attorney, Agent, or Firm*—George L. Rideout, Esq.; Armstrong Teasdale LLP

(57) ABSTRACT

A method for operating a refrigerator including a fresh food compartment and a door includes providing a fresh food evaporator to produce cool airflow for the fresh food compartment, providing a chiller compartment within the fresh food compartment, providing a duct member in flow communication with the fresh food evaporator and the chiller compartment, and channeling cool airflow to the chiller compartment via the duct member.

20 Claims, 4 Drawing Sheets

METHODS AND APPARATUS FOR OPERATING A REFRIGERATOR

BACKGROUND OF THE INVENTION

This invention relates generally to methods and apparatus for operating a refrigerator, and more particularly, to methods and apparatus for operating a refrigerator having a chiller compartment.

A typical household refrigerator includes a freezer storage compartment and a fresh food storage compartment either arranged side-by-side or separated by a center mullion wall or over-and-under and separated by a horizontal center mullion wall. Shelves and drawers typically are provided in the fresh food compartment, and shelves and wire baskets typically are provided in the freezer compartment. In addition, an ice maker may be provided in the freezer compartment. A freezer door and a fresh food door close the access openings to the freezer and fresh food compartments, respectively.

Known refrigerators typically require extended periods of time to cool food and beverages placed therein. For example, it typically takes about four hours to cool a six pack of soda to a temperature of about 45° Fahrenheit ("F"). Beverages, such as soda, are often desired to be chilled in much less time than several hours. Thus, occasionally these items are placed in a freezer compartment for rapid cooling. If not closely monitored, the items will freeze and possibly break the packaging enclosing the item and creating a mess in the freezer compartment.

Numerous quick chill and super cool compartments located in refrigerator fresh food storage compartments and freezer compartments have been proposed to more rapidly chill and/or maintain food and beverage items at desired controlled temperatures for long term storage. Conventional compartments generally have duct systems attracting cold air from the freezer compartments, and utilize an existing freezer fan to channel cold air into the compartments. As a result, food or beverage items placed in chill compartments are susceptible to undesirable freezing if too much cold air is drawn from the freezer compartment into the chill compartment. Moreover, the duct systems may become frozen if moist air is input into the duct system and then cooled. In addition, conventional chill compartments may undesirably reduce refrigerator compartment space.

Accordingly, it would be desirable to provide a refrigerator having a quick chill compartment located within the fresh food compartment wherein the quick chill compartment maintains a colder temperature than the fresh food compartment and the quick chill compartment is always above freezing.

BRIEF DESCRIPTION OF THE INVENTION

In one aspect, a method for operating a refrigerator including a fresh food compartment and a door is provided. The method includes providing a fresh food evaporator to produce cool airflow for the fresh food compartment, providing a chiller compartment within the fresh food compartment, providing a duct member in flow communication with the fresh food evaporator and the chiller compartment, and channeling cool airflow to the chiller compartment via the duct member.

In another aspect, a refrigerator is provided including a fresh food compartment, and a fresh food evaporator in flow communication with the fresh food compartment and producing cool airflow therein. The refrigerator also includes a chiller compartment positioned within the fresh food compartment, and a duct member configured to transmit cool airflow from the fresh food evaporator into the chiller compartment.

In yet another aspect, a chiller compartment is provided for use with a refrigerator including a fresh food compartment, and a fresh food evaporator. The chiller compartment includes an enclosure defining a cavity configured to receive refrigerated items therein, and an inlet extending through the enclosure. The inlet is configured to receive cooling air from the fresh food evaporator such that the chiller compartment operates at a temperature below the operating temperature in the fresh food compartment.

In a further aspect, a chiller compartment assembly is provided for use with a refrigerator including a refrigerator door having an inner liner, a fresh food compartment, and a fresh food evaporator. The chiller compartment assembly includes an enclosure defining a cavity configured to receive refrigerated items therein. The chiller compartment assembly also includes at least one positioning element extending from an exterior surface of the enclosure, and a door insert configured to be coupled to the inner liner of the refrigerator door. The door insert includes at least one shoulder extending from an interior surface of the door insert, and the shoulder is configured to engage the positioning element.

DETAILED DESCRIPTION OF THE INVENTION

Figure 1:
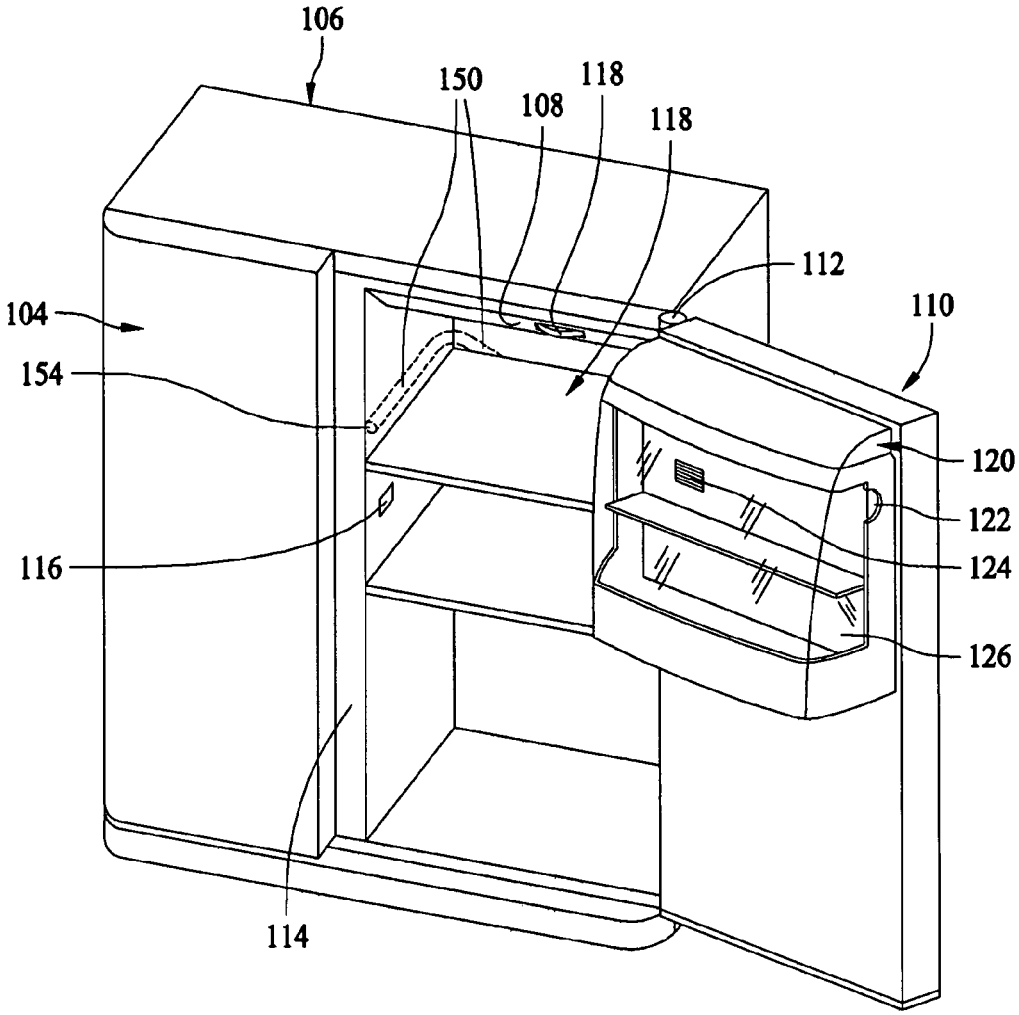
FIG. 1 is an exemplary side-by-side refrigerator which has a chiller compartment according to an exemplary embodiment of the present invention.

FIG. 1 illustrates an exemplary side-by-side refrigerator 100 in which the present invention may be practiced. It is recognized, however, that the benefits of the present invention may be accrue to types of refrigerators, and consequently, the description set forth herein is for illustrative purposes only and is not intended to be limiting in any aspect. Refrigerator 100 includes a fresh food (FF) compartment 102 and freezer (FZ) compartment 104 which are divided by a center mullion 114. In the exemplary embodiment, freezer compartment 104 and fresh food compartment 102 are arranged side-by-side. In an alternative embodiment, freezer compartment 104 and fresh food compartment 102 are arranged in a top and bottom arrangement.

In the exemplary embodiment, a temperature control 118 is positioned within FF compartment 102 for setting a desired temperature for the FF compartment 102 and/or the FZ compartment 104. Additionally, a temperature sensor 116 is positioned within FF compartment 102 for determining the temperature of the air within FF compartment 102. In one embodiment, temperature sensor 116 is a resistance temperature detector (RTD) to detect the temperature of FF compartment 102, and to ensure that the temperature in FF compartment 102 remains within predetermined limits, such as, but not limited to, a set range of, for example, within approximately 5-10° F. of the set temperature. In the exemplary embodiment, temperature sensor 116 is operatively coupled to a controller (not shown), such as, for example, a microprocessor, for controlling the temperature of FF compartment.

Refrigerator 100 includes an outer case 106 and an inner liner 108. The space between case 106 and liner 108 is filled with an insulating material, such as, but not limited to, a foamed-in-place insulation. Additionally, the space within mullion 114 is filled with an insulating material, such as, but not limited to, a foamed-in-place insulation. Outer case 106 is normally formed by folding a sheet of a suitable material, such as pre-painted steel, into an inverted U-shape to form top and sidewalls of case 106. A bottom wall of case 106 is normally formed separately and attached to the case sidewalls and to a bottom frame (not shown) that provides support for refrigerator 100. Inner liner 108 is molded from a suitable plastic material to form freezer compartment 104 and fresh food compartment 102, respectively. Alternatively, liner 108 may be formed by bending and welding a sheet of a suitable metal, such as steel.

A rotatable door 110 closes access openings to fresh food compartment 102. Door 110 is mounted by a top hinge 112 and a bottom hinge (not shown) to rotate about its outer vertical edge between an open position, as shown in FIG. 1, and a closed position (not shown) closing the fresh food storage compartment 102. An inner liner (not shown) is generally mounted within rotatable door 110. The inner liner is generally made of plastic materials. The space between door 110 and the inner liner is also filled with foamed materials to better maintain the temperature in refrigerator 100.

In the exemplary embodiment, a chiller compartment 120 is located within rotatable door 110. During operation of the refrigerator 100, chiller compartment 120 is configured to be operated at a temperature that is different than FF compartment 102 temperature, but above the freezing temperature. Specifically, chiller compartment 120 is operated at a lower temperature than FF compartment 102 to facilitate chilling refrigerated items such as, but not limited to, beverages. Chiller compartment 120 operates as a quick chill compartment to chill refrigerated items more quickly than if the items were placed directly into the FF compartment 102, and without the risk of freezing. In the exemplary embodiment, chiller compartment 120 is fabricated from a material such as, for example, a plastic material. Moreover, in the exemplary embodiment, chiller compartment 120 includes an air inlet 122 formed in a sidewall 126 of chiller compartment 120 for injecting cool air into chiller compartment 120. Additionally, in one embodiment, an air outlet 124 is formed in chiller compartment 120 for expelling cool air therefrom.

Figure 2:
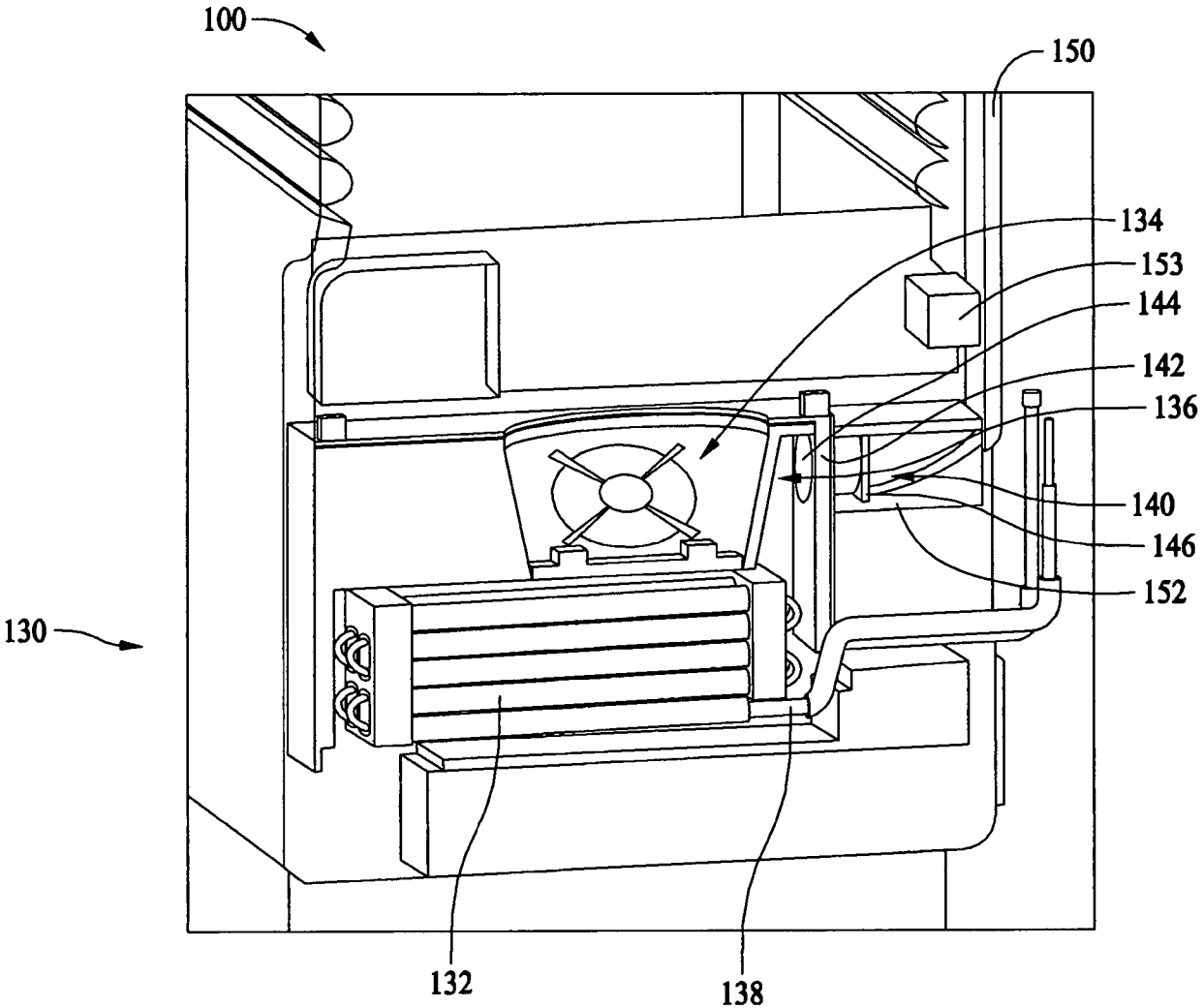
FIG. 2 is a partial cutaway view of the refrigerator in FIG. 1 viewed from a back angle.

FIG. 2 is a partial cutaway view of a rear portion of refrigerator 100 illustrating a FF cooling system 130. In the exemplary embodiment, FF cooling system 130 includes a FF evaporator 132 positioned at a backside of refrigerator 100 for producing cool air for FF cooling system 130. FF cooling system 130 also includes a FF fan 134 positioned in an airflow path 136 of FF cooling system 130 for channeling cool air into FF storage compartment 102 (shown in FIG. 1). In one embodiment, FF cooling system 130 includes an evaporator temperature sensor 138, such as, for example, a thermistor, for determining the temperature of coolant in evaporator 132.

In the exemplary embodiment, FF cooling system 130 also includes a chiller compartment cooling sub-system 140 for cooling chiller compartment 120 (shown in FIG. 1). Specifically, a divider 142, made of an insulating material, such as, but not limited to, an expanded polystyrene (EPS) material, is positioned adjacent to FF evaporator 132 and FF fan 134. Divider 142 includes an inlet 144 for allowing passage of a portion of the cool air produced by FF evaporator 132 to be channeled into chiller compartment cooling sub-system 140. In one embodiment, chiller compartment cooling sub-system 140 includes a fan 146 positioned within inlet 144 of divider 142. In one embodiment, fan 146 is a variable speed fan. Fan 146 facilitates channeling cool air through chiller compartment cooling sub-system 140. In the exemplary embodiment, an electric motor (not shown) drives fan 146 and is operatively coupled to a controller (not shown), such as, for example, a microprocessor (not shown), for controlling the amount of cool air channeled into sub-system 140. The airflow from fan 146 is channeled through a duct 150 that extends through mullion 114 (shown in FIG. 1) between FF storage compartment 102 and freezer storage compartment 104. In one embodiment, sub-system 140 includes a reducer 152 having a transition section that is connected between fan 146 and duct 150.

In one embodiment, FF cooling system 130 also includes a heater 153 coupled to duct 150. Heater 153 facilitates reducing moisture within duct 150, thus reducing a risk of freezing within duct 150. Additionally, heater 153 facilitates preventing icing within and around duct 150. In another embodiment, heater 153 is utilized to defrost duct 150.

Returning to FIG. 1, duct 150 includes an outlet 154 extending through mullion 114 into FF compartment 102. Outlet 154 is oriented such that duct 150 is in flow communication with air inlet 122 of chiller compartment 120 when door 110 is in the closed position. As such, cool air produced by FF evaporator 132 (shown in FIG. 2) is channeled to chiller compartment 120 via duct 150.

Figure 3:
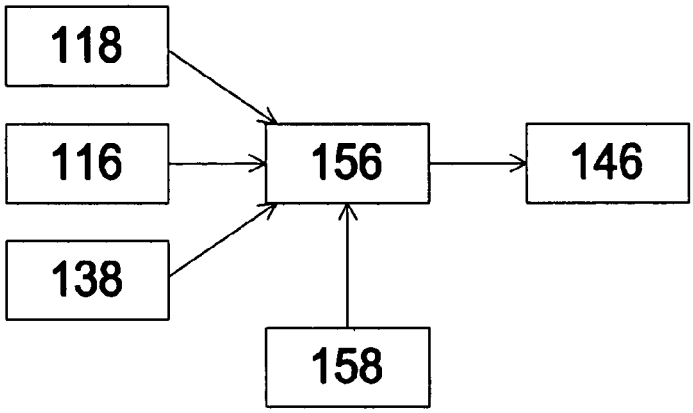
FIG. 3 is a flow diagram of the operation of a chiller compartment cooling system for use with the refrigerator shown in FIGS. 1 and 2.

FIG. 3 is a flow diagram of the operation of chiller compartment cooling sub-system 140. Specifically, refrigerator 100 includes a controller 156, such as, for example, a microprocessor. Controller 156 receives a plurality of inputs. Specifically, in the exemplary embodiment, controller 156 receives an input from temperature control 118 (FIG. 1) relating to a user entered set temperature. Additionally, controller 156 receives an input from FF compartment temperature sensor 116 (FIG. 1) relating to the temperature of the air in FF compartment 102. Moreover, controller 156 receives an input from FF evaporator temperature sensor 138 (FIG. 2) relating to the temperature of the coolant in evaporator 132. In one embodiment, controller 156 also receives an input 158 relating to a freezing limit of the cooling air supplied to chiller compartment cooling sub-system 140 (FIG. 2). Specifically, the freezing limit input causes controller 156 to cease operation when cooling sub-system 140 is approaching the freezing limit. As such, controller 156 facilitates reducing the risk of freezing in cooling sub-system 140. In an alternative embodiment, controller 156 receives an input from a temperature sensor (not shown) positioned within chiller compartment 120 (FIG. 1) relating to the temperature of the air in chiller compartment 120.

In the exemplary embodiment, controller 156 is operatively coupled to chiller compartment fan 146. As such, controller 156 determines a mode of operation of chiller compartment fan 146 based on the inputs received by controller 156. In one embodiment chiller compartment fan 146 operates in either an "ON" or an "OFF" mode of operation. In another embodiment, chiller compartment fan 146 is a variable speed fan and operates at multiple speeds. In one embodiment, controller 156 may also be operatively coupled to FF fan 134.

Figure 4:
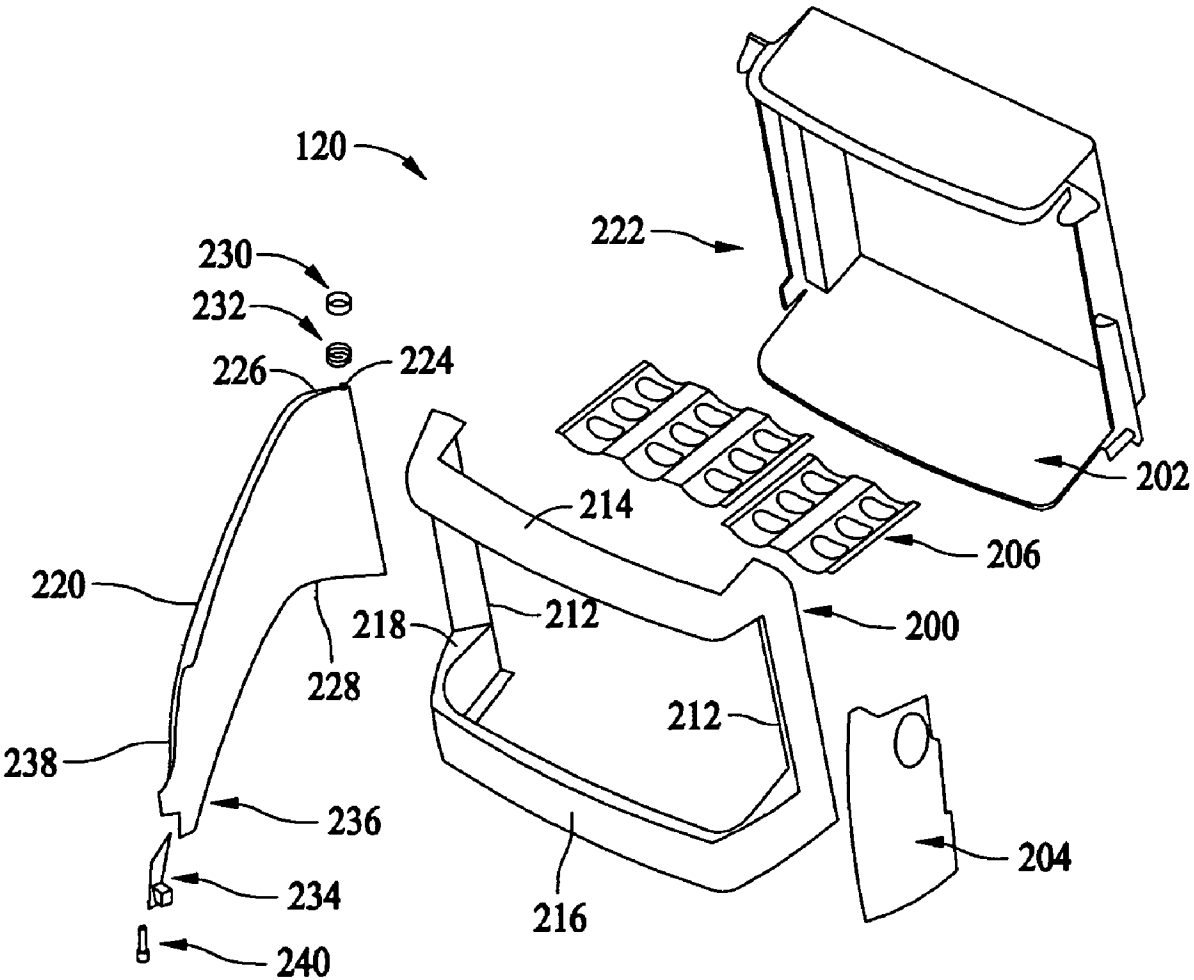
FIG. 4 is an exploded perspective view of a chiller compartment according to an exemplary embodiment of the present invention.

FIG. 4 is an exploded perspective view of chiller compartment 120 including a front panel 200, a back panel 202, and a side panel 204 which are assembled together to form a compartment for refrigerated items. Optionally, the items may be stored at a lower temperature that other items that are stored in FF compartment 102. In an alternative embodiment, front panel 200, back panel 202, and side panel 204 are unitarily formed. Optionally, chiller compartment 120 includes shelves 206. Front panel 200 includes a top member 214, a bottom member 216, and a pair of side members 212 connected between top and bottom members 214 and 216. In the exemplary embodiment, apertures 218 are formed in both top and bottom members 214 and 216 proximate one side member 212. Specifically, an upward facing aperture 218 is formed in bottom member 216 generally vertically below and substantially aligned with a downward facing aperture 218 in top member 214. Apertures 218 are configured to receive a chiller compartment door 220.

Chiller compartment door 220 covers a cavity 222 defined by front and back panels 200 and 202, respectively. Door 220 includes a pair of projections 224 extending outwardly from a top side 226 and a bottom side 228 of door 220. Projections 224 are oriented for insertion into corresponding apertures 218 of front panel 200. A biasing member 230, such as, for example, a bias spring 232, is positioned between projections 224 and apertures 218. In operation, when a user opens chiller compartment door 220 to access chiller compartment 120, biasing member 230 provides a biasing force on door 220 to retain door 220 in an open position. As such, biasing member 230 facilitates accessing chiller compartment 120 without a user having to hold chiller compartment door 220 in an open position because door 220 remains in the open position by the biasing force.

In one embodiment, biasing member 230 retains door 220 in an open position that is substantially orthogonal with respect to front panel 200. In another embodiment, biasing member 230 retains door 220 in an open position that is approximately 110° with respect to front panel 200. As such, the user can close refrigerator door 110 without chiller compartment door 220 interfering with mullion 114 (shown in FIG. 1). Accordingly, biasing member 230 facilitates reducing the risk of door 220 jamming with mullion 114. In an alternative embodiment, biasing member 230 exerts a closing force on chiller compartment door 220 such that door 220 is closed when not forced open by the user.

In the exemplary embodiment, a latch mechanism 234 is coupled to chiller compartment door 220 and engages with side panel 204 to retain door 220 in a closed position. Specifically, an opening 236 is defined in a distal side 238 of chiller compartment door 220 and latch mechanism 234 is positioned within opening 236. In the exemplary embodiment, latch mechanism 234 is received in opening 236 and an elastic latch button 240 is engaged with latch mechanism 234. In the exemplary embodiment, latch button 240 releases latch mechanism 234 from side panel 204 such that chiller compartment door 220 may be opened.

Figure 5:
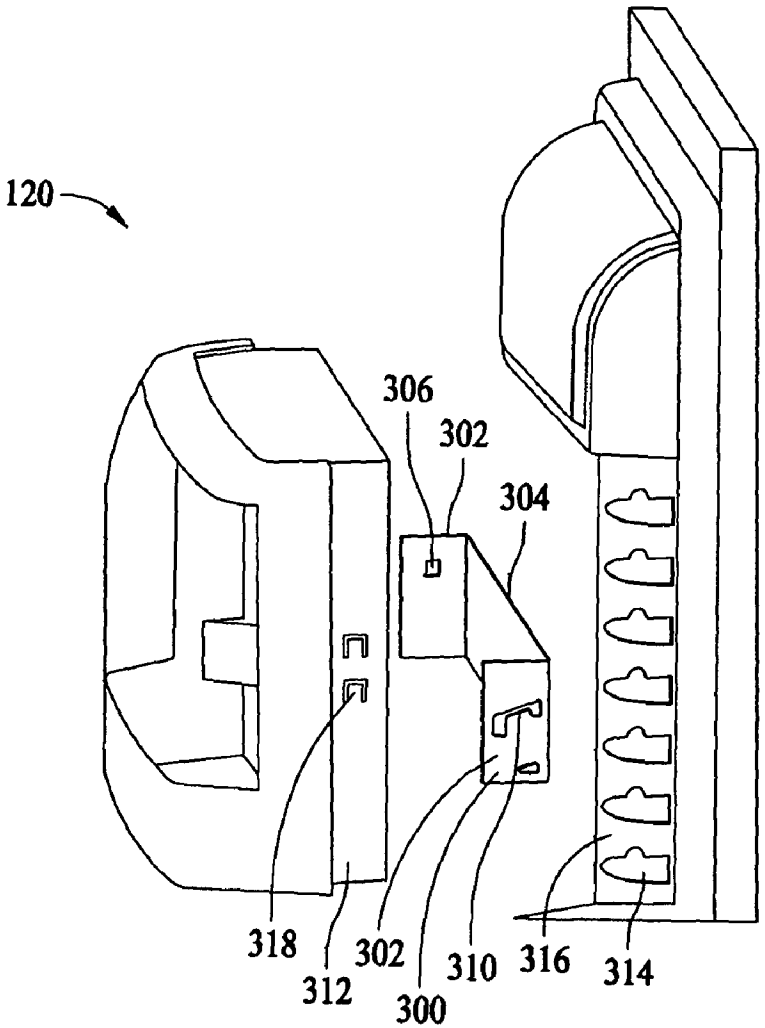
FIG. 5 is an exploded perspective view of an attachment mechanism for use with the chiller compartment shown in FIG. 4.

FIG. 5 is an exploded, perspective view of a door insert 300 provided to couple chiller compartment 120 to refrigerator door 110. Door insert 300 has a "U" shape and is made of a rigid material such as, for example, a plastic material or a metal material. Door insert 300 includes opposite sidewalls 302 and a back wall 304 connected therebetween. A shoulder 306 is located on an inner surface 308 of each sidewall 302. A positioning member 310 is located on an outer surface 312 of each sidewall 302. A plurality of support members 314 extends from an inner liner 316 of door 110 for positioning door insert 300 within door 110. Specifically, support members 314 are oriented at different positions along inner liner 316 such that door insert 300 may be coupled to inner liner 316 of refrigerator door 110 at multiple positions.

In the exemplary embodiment, chiller compartment 120 has at least one positioning element 318 formed on each side thereof. Positioning elements 318 are oriented to be coupled to corresponding shoulders 306 extending from door insert inner surfaces 308. Specifically, chiller compartment 120 has a width that is less than the width of door insert 300 such that chiller compartment 120 can be positioned within door insert 300. In assembly, door insert 300 is positioned within door 110 such that positioning member 310 is substantially aligned with a corresponding support member 314 prior to being coupled thereto. Once coupled at a predetermined position, chiller compartment 120 is positioned within door insert 300 such that positioning elements 318 are substantially aligned with corresponding shoulders 306 prior to being coupled thereto. Positioning elements 318 engage shoulders 306 by moving chiller compartment 120 along a generally vertical path of movement. Due to the multiple positions available for door insert 300 to be coupled in refrigerator door 110, chiller compartment is useable with different sized FF liners 316. Alternatively, refrigerator door 110 is capable of receiving multiple sized chiller compartments 120.

A refrigerator having a chiller compartment is thus obtained by modulating a FF fan at the FF evaporator to direct cool air from the FF evaporator to the chiller compartment. As such, the chiller compartment is not cooled by air from a FZ compartment, thus reducing the risk of freezing the duct supplying air and the refrigerated items in the chiller compartment.

While the invention has been described in terms of various specific embodiments, those skilled in the art will recognize that the invention can be practiced with modification within the spirit and scope of the claims.

What is claimed is:

1. A method for operating a refrigerator including a fresh food compartment, a freezer compartment, and a door configured to be moveable between an open position and a closed position, said method comprising:

providing a fresh food evaporator to produce cool airflow for the fresh food compartment;

directly coupling a quick chiller compartment to an inner liner of the door, wherein the quick chiller compartment includes at least one air inlet;

providing a divider positioned adjacent to the fresh food evaporator, the divider defining a divider inlet for directing a portion of the cool air flow produced by the fresh food evaporator to flow into the quick chiller compartment and a divider outlet; and channeling cool airflow to the quick chiller compartment from the fresh food evaporator via the divider, wherein the divider inlet is adjacent to the fresh food evaporator and an the divider outlet is adjacent to the air inlet of the quick chiller compartment, such that the divider outlet is coupled directly to the air inlet of the quick chiller compartment to provide cool air flow into the quick chiller compartment when the door is in the closed position and the divider outlet is decoupled from the air inlet of the quick chiller compartment to prevent cool air flow into the quick chiller compartment when the door is in the open position.

2. A method in accordance with claim 1 further comprising providing a controller for controlling the temperature in the quick chiller compartment.

3. A method in accordance with claim 2 further comprising:

providing a fan member within the divider inlet for directing a desired amount of cool airflow from the fresh food evaporator to the quick chiller compartment; and operating the fan member based on a feedback signal provided by the controller such that a temperature in the quick chiller compartment is substantially maintained.

4. A method in accordance with claim 1 further comprising:

providing a temperature control;

selecting a set temperature point for the fresh food compartment on the temperature control;

coupling a temperature sensor to at least one of the fresh food evaporator, the fresh food compartment, and the quick chiller compartment;

coupling a controller in operational communication with the temperature control and the temperature sensor; and operating the fresh food evaporator based on a feedback signal provided by the controller such that a temperature in the quick chiller compartment is substantially maintained.

5. A method in accordance with claim 4 further comprising providing a no freeze limit input to the controller such that the controller will cease operation of the fresh food evaporator prior to the quick chiller compartment reaching a freezing limit.

6. A refrigerator comprising:

a cabinet defining a fresh food compartment and a freezer compartment;

a door movably coupled to the cabinet between an open position and a closed position, said door comprising an inner liner;

a fresh food evaporator in flow communication with said fresh food compartment and producing cool airflow therein;

a quick chiller compartment directly coupled to said inner liner and comprising at least one air inlet; and a divider positioned adjacent to said fresh food evaporator, said divider defining a divider inlet for directing a portion of the cool air flow produced by said fresh food evaporator to flow into said quick chiller compartment and a divider outlet, said divider inlet adjacent to said fresh food evaporator, said divider outlet adjacent to said quick chiller compartment, and a duct extending therebetween, said divider outlet coupled directly to said air inlet of said quick chiller compartment to provide cool air flow into said quick chiller compartment when said door is in the closed position and said divider outlet is decoupled from said air inlet of said quick chiller compartment to prevent cool air flow into said quick chiller compartment when said door is in the open position.

7. A refrigerator in accordance with claim 6 further comprising a fan member positioned within said divider inlet to direct the cool airflow from said evaporator to said quick chiller compartment.

8. A refrigerator in accordance with claim 6 further comprising:

a fan member positioned within said divider inlet to direct the cool airflow from said evaporator to said quick chiller compartment; and a controller operatively coupled to said fan member, said controller configured to modulate said fan member according to a feedback signal transmitted to said fan member from said controller.

9. A refrigerator in accordance with claim 6 further comprising:

a fresh food fan in flow communication with said fresh food evaporator;

a reducer in flow communication with said fresh food fan; and a quick chiller compartment fan positioned within said reducer and in flow communication with said fresh food fan.

10. A refrigerator in accordance with claim 9 further comprising a controller for controlling said fresh food fan and said quick chiller compartment fan.

11. A refrigerator in accordance with claim 6 further comprising a heater coupled to said duct, said heater facilitates reducing a risk of freezing of said duct.

12. A quick chiller compartment for use with a refrigerator including a door hingedly coupled to the refrigerator, a fresh food compartment, a freezer compartment, and a fresh food evaporator, the door configured to be moveable between an open position and a closed position, said quick chiller compartment comprising:

an enclosure defining a cavity configured to receive refrigerated items therein, said enclosure configured to be directly coupled to an inner liner of the door; and an air inlet extending through said enclosure, said air inlet configured to receive cooling air directly from a divider positioned adjacent to said fresh food evaporator, said divider defining a divider inlet for directing a portion of the cool air flow produced by said fresh food evaporator to flow to said divider inlet adjacent to the fresh food evaporator, a divider outlet adjacent to said quick chiller compartment, and a duct extending therebetween such that said divider outlet is coupled directly to said air inlet of said quick chiller compartment to provide cool airflow into said quick chiller compartment when the door is in the closed position and said divider outlet is decoupled from said air inlet of said quick chiller compartment to prevent cool airflow into said quick chiller compartment when the door is in the open position, wherein said quick chiller compartment operates at a temperature below an operating temperature in the fresh food compartment.

13. A quick chiller compartment in accordance with claim 12 further comprising a chiller compartment door rotatably coupled to said enclosure and configured to allow access to the refrigerated items contained within the cavity.

14. A quick chiller compartment in accordance with claim 12 further comprising a chiller compartment door rotatably coupled to said enclosure, and a biasing mechanism coupled to said chiller compartment door and configured to retain said chiller compartment door in an open position when the cavity is being accessed by a user.

15. A quick chiller compartment in accordance with claim 12 further comprising a quick chiller compartment door rotatably coupled to said enclosure, said quick chiller compartment door comprising a latch mechanism configured to engage a side panel of said enclosure to thereby retain said quick chiller compartment door in a closed position.

16. A quick chiller compartment in accordance with claim 12 further comprising at least one positioning element extending from an exterior surface of said enclosure, said at least one positioning element configured to engage a shoulder extending from a door insert coupled to an inner liner of the door.

17. A quick chiller compartment assembly for use with a refrigerator including a door having an inner liner, a fresh food compartment, a freezer compartment, and a fresh food evaporator, the door configured to be moveable between an open position and a closed position, said quick chiller compartment assembly comprising:

an enclosure defining a cavity configured to receive refrigerated items therein, said enclosure configured to be directly coupled to the inner liner;

an air inlet extending through said enclosure, said air inlet configured to receive cooling air directly from a divider positioned adjacent to said fresh food evaporator, said divider defining a divider inlet for directing a portion of the cool air flow produced by said fresh food evaporator to flow to said divider inlet adjacent to the fresh food evaporator, a divider outlet adjacent to said quick chiller compartment assembly, and a duct extending therebetween such that said divider outlet is coupled directly to said air inlet of said quick chiller compartment assembly to provide cool airflow into said quick chiller compartment when the door is in the closed position and said divider outlet is decoupled from said air inlet of said quick chiller compartment assembly to prevent cool airflow into said quick chiller compartment when the door is in the open position, wherein said quick chiller compartment assembly operates at a temperature below an operating temperature in the fresh food compartment;

at least one positioning element extending from an exterior surface of said enclosure; and a door insert configured to be coupled to the inner liner of the door, said door insert comprising at least one shoulder extending from an interior surface of said door insert, said at least one shoulder configured to engage said at least one positioning element.

18. A quick chiller compartment assembly in accordance with claim 17 where said door insert further comprises at least one positioning member extending from an exterior surface of said door insert, each of said at least one positioning members configured to engage corresponding support members extending from the inner liner of the door.

19. A quick chiller compartment assembly in accordance with claim 17 wherein said enclosure comprises secondary positioning elements on each side of said enclosure, said secondary positioning elements configured to engage corresponding secondary shoulders for orienting said enclosure with respect to said door insert.

20. A quick chiller compartment assembly in accordance with claim 17 wherein said positioning elements are configured to engage said shoulders along a generally vertical path of movement.

* * * * *